US005288069A

United States Patent [19]

Matsumoto

[11] Patent Number: 5,288,069

[45] Date of Patent: Feb. 22, 1994

[54] TALKING FOOTBALL

[76] Inventor: Susan Matsumoto, 22 Lynn Ct., Hampton Bays, N.Y. 11946

[21] Appl. No.: 979,249

[22] Filed: Nov. 20, 1992

[51] Int. Cl.[5] ..... A63B 71/00; A63B 43/00

[52] U.S. Cl. ..... 273/65 EF; 273/58 G; 273/58 A; 273/65 A; 273/138 A; 446/484

[58] Field of Search ..... 273/58 G, 138 A, 65 EF, 273/65 A, 65 R, 58 R; 446/484, 397

[56] References Cited

U.S. PATENT DOCUMENTS

| | | | |
|---|---|---|---|
| 4,595,200 | 6/1986 | Shishido | 273/58 G |
| 4,858,931 | 8/1989 | McKechnie | 273/138 A |
| 5,049,107 | 9/1991 | De Nittis | 446/484 X |
| 5,054,778 | 10/1991 | Maleyko | 273/58 G |
| 5,125,866 | 6/1992 | Araf | 446/484 X |
| 5,203,560 | 4/1993 | Wang | 273/58 G X |

*Primary Examiner*—George J. Marlo
*Attorney, Agent, or Firm*—Michael Ebert

[57] ABSTRACT

A talking, soft football for young children, which when caught by a player then emits an audible voice message or crowd roar sounds appropriate to the game of football. The football is formed by an elliptical casing of flexible plastic enclosing a core of compressible material. Nested in a cavity in the core is an electronic module, access to which is had by way of a longitudinal slit in the casing that is closable by a lacing so that the soft football looks like a regulation football. Housed in the module at one side thereof adjacent the inner surface of the casing are a miniature loudspeaker from which the voice messages and crowd roar sounds are emitted, and a piezoelectric sensor which generates a command signal only when the football is caught by a player and impacts on his hands. Also housed in the module are batteries and an integrated circuit chip powered thereby, the chip being normally quiescent and being activated by the command signal. Included in the chip is a solid-state data memory having digitally stored therein several different voice messages and crowd roar sounds, and readout means, which when the chip is activated then selects at random one of the messages or crowd roar sounds, and decodes and amplifies the selection to yield an audio signal which is applied to the loudspeaker and reproduced thereby.

15 Claims, 2 Drawing Sheets

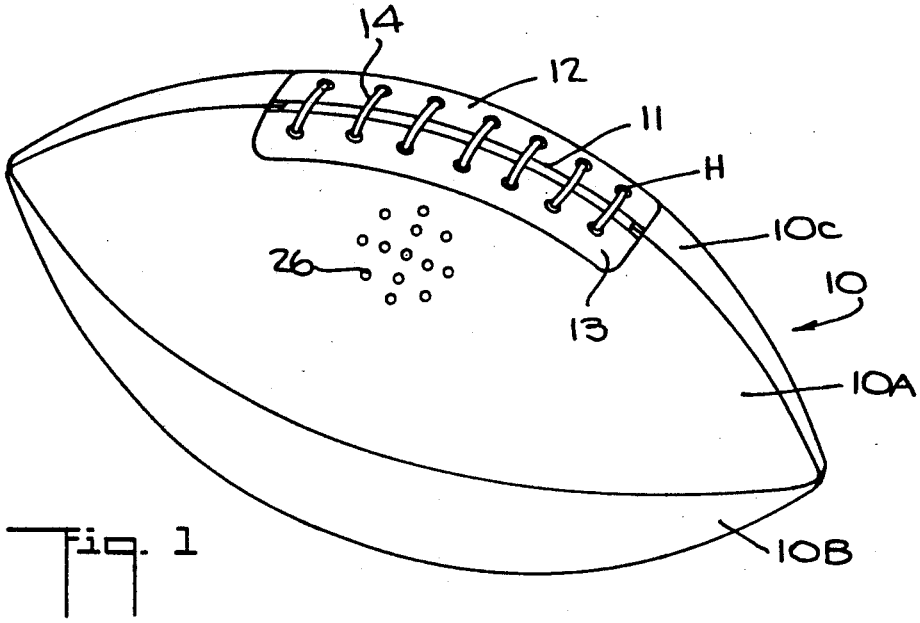
Fig. 1
Fig. 2
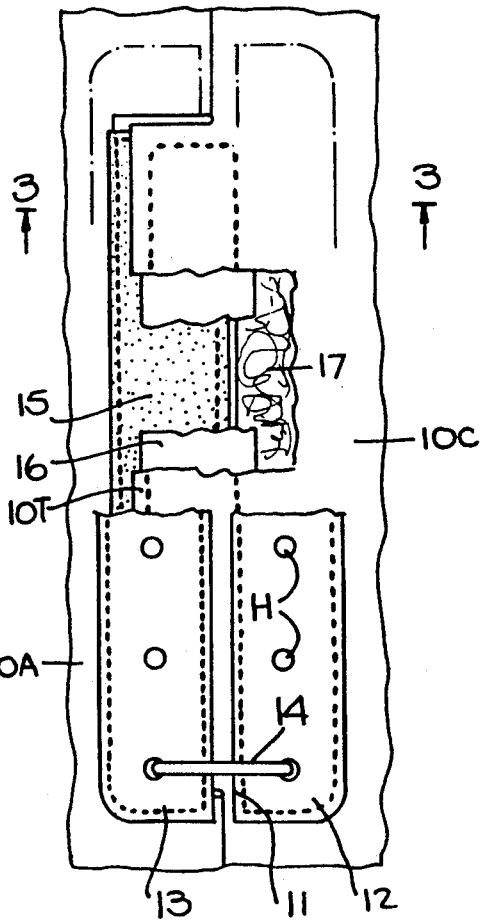
Fig. 4
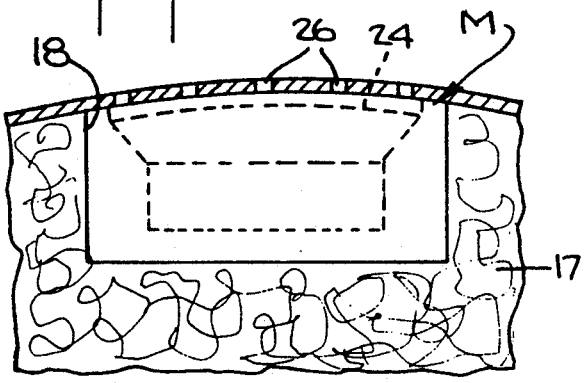
Fig. 3
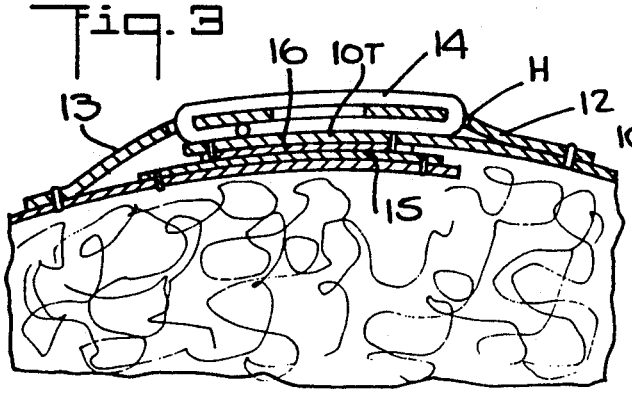

TALKING FOOTBALL

BACKGROUND OF INVENTION

1. Field of Invention

This invention relates generally to soft and safe footballs for young children, and more particularly to a talking football of this type, which when caught by a player then emits a selected voice message or crowd roar sounds so that children who play with this ball experience a sense of participating in a professional game being played in a stadium.

2. Status of Prior Art

The game of football is played on a field by two opposing teams, each having eleven men, play being directed toward advancing a football or pigskin, as it is often called, across the opponent's goal line to score a touchdown. The football is formed by a tough, leather outer casing having an elliptical shape enclosing an inflated bladder which is introduced through a long slit in the casing that is closable by lacing.

In the course of play, the players seek to catch the ball and run with it toward the goal line. But if the ball carrier fumbles and loses possession of the ball, an opposing player may recover the ball and run with it in the opposite direction. Blocking and tackling techniques are used to intercept a player carrying the ball. As a consequence, football is one of the most rugged sports and dictates that the players wear protective gear such as helmets, kidney guards, and hip and shoulder braces.

Regulation football is therefore not a game suitable for young children. Yet many of these children are enthusiastic spectators at professional and collegiate football games played in stadiums and take delight in the roar of the crowd when a touchdown is scored and in other exciting incidents which take place in the course of play.

In order to make it possible for young children to play a simplified version of football which requires no protective gear, yet is safe to play, now available for this purpose are soft footballs. These have the same appearance as a regulation football, but in a somewhat smaller scale. In a soft football, instead of a leather outer casing, use is made of a casing formed of soft, flexible plastic material that is easy for a child to grip, and instead of an inflatable bladder, the casing encloses a compressible core of cotton batting or sponge-like, flexible foam plastic material. While a soft football of this type can be manipulated, thrown and kicked like a regulation football, it is altogether innocuous and will inflict no injury when striking a child.

Though children enjoy playing with a soft football in a manner imitating a real game, they do not then experience the excitement of a real game; for what is lacking is the roar of the crowd and the verbal exclamations from those participating in the game, such as "Touchdown," "Great Catch," "Fumble," and "Penalty." The sounds which accompany a real game of football are inseparable from the overall game experience; hence, the absence of these sounds is like watching a football game on TV with the sound turned off.

With a view to enlivening ball play for children, it is known in the prior art to provide balls which emit sounds or produce light effects when the ball is caught by a player. Thus, the 1989 U.K. patent publication GB 2,213,069 discloses a rubber play ball that incorporates a battery-operated sound board and a loudspeaker coupled thereto, as well as an impact sensor that activates the sound board, so that when the ball is caught, the speaker then emits a "bang" sound.

The 1989 Rumsey U.S. Pat. No. 4,801,141, discloses a play ball that produces a tone whose pitch depends on the orientation of the ball. Also disclosing balls which produce different tones are the 1988 Rumsey U.S. Pat. No. 4,737,134, and the 1987 Rumsey U.S. Pat. No. 4,662,260. The 1971 Speeth U.S. Pat. No. 3,580,575, shows a ball that incorporates colored lamps which are turned on upon impact, the lamp activated depending on the point of impact.

Of greatest prior art interest is the 1986 Shishido U.S. Pat. No. 4,595,200. This discloses a sound-emitting ball having an inflated bladder and provided with an impact sensor and an LSI speech system which includes a ROM for digitally storing the voice messages, ONCE, TWICE and so on. These sounds are produced in sequence, depending on how many times the ball is caught.

In practical terms, the drawback of the Shishido arrangement is that the voice message to be generated when the ball is caught is always predictable, for a player knows in advance that having heard ONCE in his previous catch, he will inevitably hear TWICE on his next catch. Hence, the ball quickly loses its novelty and the player's interest wanes, for the ball lacks the element of surprise.

Another drawback of prior art balls which emit sounds is that the impact sensor and the components of the sound storage and playback system are discrete elements which are distributed within the ball, as a consequence of which the ball is relatively difficult to assemble.

SUMMARY OF INVENTION

In view of the foregoing, the main object of this invention is to provide a soft and safe talking football for young children, which when caught by a player then emits a voice message and/or crowd roar sounds that are appropriate to a real game of football.

A significant feature of the invention is that stored in the talking football are different voice messages; but when the ball is successively caught by a player, the voice messages are not in a predetermined sequence, but are emitted in random order. Hence a player catching the ball does not know in advance what voice message he will hear. Because of its unpredictability, a talking football in accordance with the invention retains an element of surprise to maintain the interest of the player.

Also an object of the invention is to provide a talking football of the above type in which the sound-producing means and the battery power supply therefor are contained in a self-sufficient module which is nested within the core of the ball and can readily be installed therein or removed therefrom to replace the power supply when it is exhausted.

Yet another object of the invention is to provide a talking football for young children which is safe to play with, is reliable in operation and can withstand rough handling, and which can be mass-produced at relatively low cost.

Briefly stated, these objects are attained in a talking, soft football for young children, which when caught by a player then emits an audible voice message or crowd roar sounds appropriate to the game of football. The football is formed by an elliptical casing of flexible plastic enclosing a core of compressible material. Nested in a cavity in the core is an electronic module, access to which is had by way of a longitudinal slit in the casing that is closable by a lacing so that the soft football looks like a regulation football.

Housed in the module at one side thereof adjacent the inner surface of the casing are a miniature loudspeaker from which the voice messages and crowd roar sounds are emitted, and a piezoelectric sensor which generates a command signal only when the football is caught by a player and impacts on his hands. Also housed in the module are batteries and an integrated circuit chip powered thereby, the chip being normally quiescent and being activated by the command signal. Included in the chip is a solid-state data memory having digitally stored therein several different voice messages and crowd roar sounds, and readout means, which when the chip is activated then selects at random one of the messages or crowd roar sounds, and decodes and amplifies the selection to yield an audio signal which is applied to the loudspeaker and reproduced thereby.

BRIEF DESCRIPTION OF DRAWINGS

For a better understanding of the invention as well as other objects and further features thereof, reference is made to the following detailed description to be read in conjunction with the accompanying drawings, wherein:

FIG. 1 is a perspective view of a talking, soft football in accordance with the invention;

FIG. 2 is a top view of the football that is partially cut away to show the Velcro closure therefor;

FIG. 3 is a section taken in the plane indicated by line 3—3 in FIG. 2;

FIG. 4 is a section taken through the football showing the relationship of the electronic module to the casing;

DESCRIPTION OF INVENTION

Figure 5:
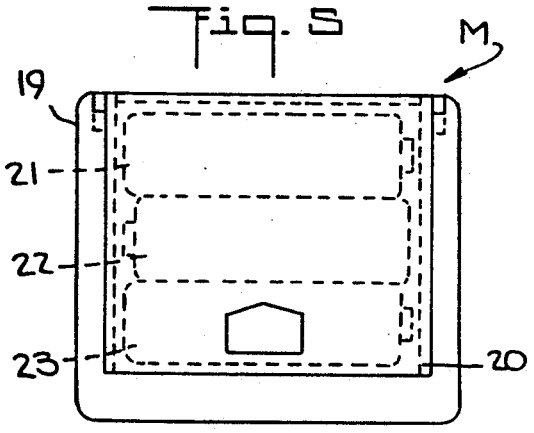
FIG. 5 is a rear view of the module showing the battery compartment therein.

Referring now to FIGS. 1 to 4, a soft football in accordance with the invention includes an outer casing 10 having an elliptical shape, the casing being formed by contoured sections 10A, 10B, 10C, etc., of flexible, synthetic plastic sheeting, such as PVC. The sections are sewn together, the sewing between adjacent sections 10A and 10C having a long unsewn gap therein defining a longitudinal slit 11. The sections of the casing may be made of contrasting colors, and alternate sections may have decorative artwork printed thereon to render the ball attractive to young players.

As best seen in FIGS. 1 and 2, joined along its outer periphery to the outer surface of casing 10 on opposite sides of slit 11 onto casing sections 10A and 10C are complementary lacing patches 12 and 13. These are formed of leather-like, synthetic plastic, flexible material, the patches being otherwise unattached so that one can go under the patches. Each patch has punched therein a row of holes H. Threaded through these holes is a lacing 14 which simulates the appearance of a regulation football in which the lacing serves to close the longitudinal slit in the leather casing through which an inflatable bladder is introduced into the casing.

Adhered to the outer surface of casing section 10A under latching patch 13 is a strip 15 which is the female component of a Velcro fabric fastener. Casing section 10C is provided with a tongue 10T which extends therefrom beyond patch 12 so as to be received in the pocket under patch 13 on casing section 10A. Adhered to the underside of tongue 10T is a strip 16, which is the male component of the Velcro fastener. Hence, when tongue 10T is inserted in the pocket under patch 13, this brings about engagement of the Velcro components and acts to seal slit 11.

Casing 10 encloses a core 17 formed of compressible material, which in practice may be cotton batting or sponge-like, flexible foam material. The core within the casing serves to maintain the elliptical shape of the casing and acts to impart soft body characteristics to the ball so that it is entirely innocuous and will not inflict injury should it strike a player.

Nested within a cavity 18 formed in core 17 adjacent the inner surface of casing 10 is an electronic module, generally identified by letter M. Module M functions to emit a voice message and/or crowd roar sounds when the football is caught by a player and impacts on his hands.

Module M, as shown separately in FIGS. 5 to 8, is provided with a box-like rectangular case 19 having a compartment 20 therein adapted to receive three small AA 1.5 V batteries 21, 22 and 23. These are connected in series to provide a 4.5 vdc power supply. The battery compartment is provided with a removable cover at the rear of case 19 so that the batteries, when exhausted, may be replaced. When, therefore, it is necessary to replace the batteries, the casing is unlaced, and the Velcro fastener is opened to expose the slit in the casing so that one can reach into the core to remove module M from its cavity.

Figure 6:
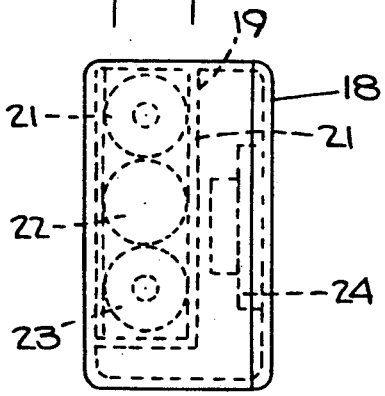
FIG. 6 is an end view of the module.
Figure 7:
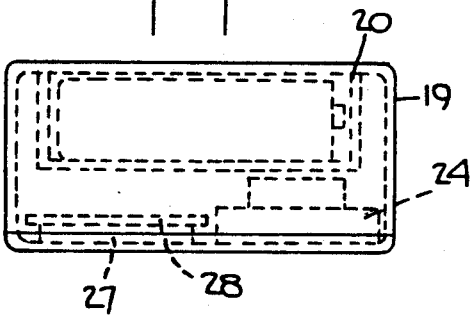
FIG. 7 is a transverse section taken through the module.
Figure 8:
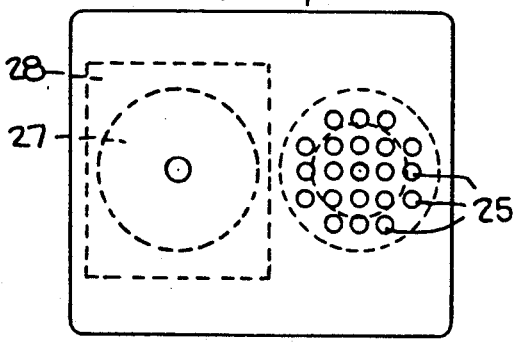
FIG. 8 is a front view of the electronic module.
Figure 9:
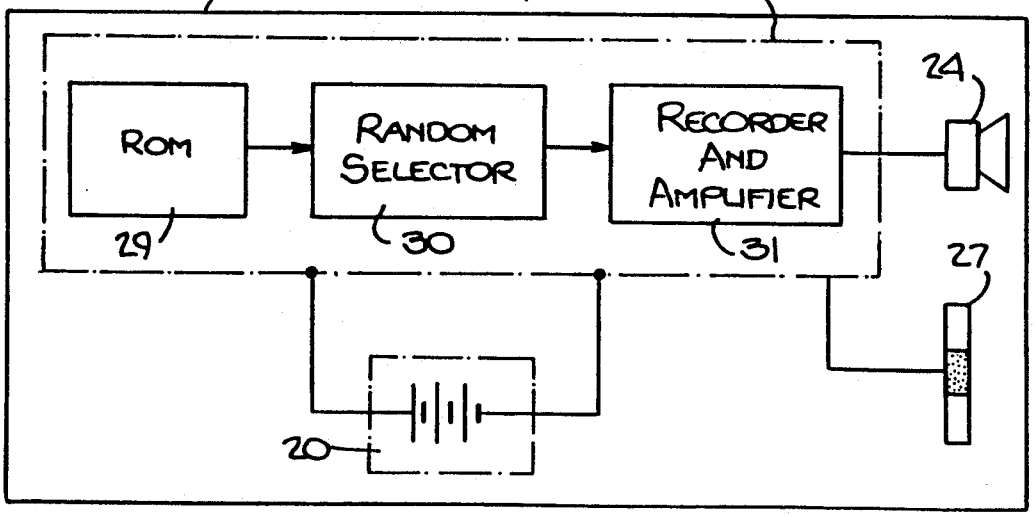
FIG. 9 is a block diagram of the circuit of the module.

Housed within module M is a miniature loudspeaker 24 which is placed against the front wall of case 19, as shown in FIGS. 6 and 7. The front wall has a circular array of apertures 25 therein to permit sound emitted by the speaker within the case to pass out of the case. The front wall of the case is placed against the undersurface of casing 10 of the football, and the casing has punched therein a matching circular array of holes 26, as shown in FIG. 1, so that the speaker sounds pass through the casing and can be heard by one holding the football and those in the vicinity of the ball.

Also housed in the case of the module and mounted on its front wall at a position adjacent speaker 24 is a piezoelectric impact sensor 27. A piezoelectric element of the natural quartz crystal type or of the ceramic type which gains piezoelectric characteristics by exposure to an orienting electric field during cooling after being fired at high temperature will generate an electrical signal when the element is subjected to a compressive or a sheer force. The function of sensor 27 is to generate a command signal when the football is caught by a player and impacts on his hands and thereby subjects the crystal to an impact force.

Supported above sensor 27 in the case of the module is an integrated circuit chip 28 which is powered by the batteries in compartment 20. The microelectronic circuits in the chip are biased so that the circuits are quiescent and are activated for a period sufficient to select and reproduce a voice message and/or crowd roar sounds only when a command signal is generated by sensor 27. Thus, the chip normally draws extremely little current when it is in its quiescent state.

The circuit of the microelectronics IC chip includes a solid-state data memory, preferably in the form of a ROM 29 (Read-Only-Memory). A ROM is a solid-state, non-vilatile memory which, once digital data is loaded into is discrete storage sites, then stays therein even if the power is shut off.

In loading a voice message or crowd roar sounds into the ROM, this data, which is in analog audio wave form, is sampled at a high sampling rate. The amplitude of each sample derived from the audio wave is digitized by an analog-to-digital converter, so that the amplitude of each sample is represented by a corresponding binary value which is stored in a discrete site in the ROM.

Loaded into ROM 29 are several different voice messages and crowd roar sound effects appropriate to the game of football. Thus, the voice messages may include GREAT CATCH, TOUCHDOWN, FUMBLE, PENALTY, and the crowd roar sounds may be cheering or jeering sounds.

The number of voice messages and crowd roar sounds that can be stored in the ROM depends on its storage capacity. Thus, if the capacity of the ROM is a minute of time or greater, then a large number of one-word different voice messages and two or more different crowd roar sounds may be stored in the ROM. But if the ROM capacity is a fraction of a minute, then the data that can be stored is more limited. But the capacity of the ROM must be such as to store at least three voice messages and one crowd roar sound, for otherwise, the talking football would not be able to sustain a player's interest.

When chip 28 is activated by a command signal from sensor 27, which is generated only upon impact when the soft football is caught by a player, it then remains activated for a period sufficient to produce a selected voice message and/or a crowd roar. The readout means for this purpose include a random selector 30 which reads out from ROM 29 one of the single word messages or crowd roar sounds stored therein, the duration of which is just about a second or so. Or the selector may be so arranged that in each instance it reads out one of the voice messages and follows this with an appropriate crowd roar. If, for example, the selected voice message is TOUCHDOWN, this should be followed by a loud cheer from the crowd. But if the message is FUMBLE, it could then be followed by a jeering crowd sound.

Important to the invention is that the selection of data from the ROM not be in a predetermined sequence, but that it be random in nature. Hence, the player, when catching the talking football, does not know what voice message or crowd roar sound will be triggered off by this action. In this way, the voice message and/or the crowd roar sound that results from catching the ball is unexpected and unpredictable.

As in a computer, random selection may be effected by a random number generator, so that if the stored data is constituted by nine different messages and crowd roar sounds, then the voice message and/or crowd roar sounds that are selected at random from the ROM will be one of the nine pieces of stored data.

The digital data yielded by selector 30 is applied to a decoder and amplifier stage 31. The decoder included in this stage is a digital-to-analog converter that converts the digital data extracted from ROM 29 by random selector 30 into a stepped audio wave signal, the stepping resulting from the sampled nature of the digital data.

The stepped audio wave signal is applied to a filter which yields an audio signal that closely resembles the original analog waveform of the message. The output of the filter is applied to an audio amplifier whose output is fed to loudspeaker 24, thereby reproducing the messages and/or the crowd roar sounds. Of background prior art interest in regard to talking toys is the De Smet et al. U.S. Pat. No. 4,884,974, which discloses a talking book in which the words forming the text of the book are digitally stored in a ROM and, on command, are extracted from the ROM, converted into an audio analog wave and reproduced.

Thus, in a talking football in accordance with the invention, the electronic module M nested in in the compressible core of the football is self-sufficient. It is, therefore, an easy matter to assemble the football; for after the outer casing thereof is filled with a compressible core through the open slit in the casing, one inserts the module in the core so that it occupies a proper position against the inner surface of the casing, closes the slit with the Velcro closure, and then laces up the football which is now in condition for play.

While there has been shown and described a preferred embodiment of a soft talking football in accordance with the invention, it will be appreciated that many modifications and changes may be made therein without, however, departing from the essential spirit thereof. For example, instead of a soft ball in the shape of a football, the ball may be spherical in form to resemble a regulation basketball, in which case the module nested within the compressible core of the ball would store voice messages and crowd roar sounds appropriate the game of basketball. Or the soft ball may resemble a baseball, in which case the module would be designed for this game.

A ball in accordance with the invention may be molded entirely of a soft, compressible, foam plastic material having embedded therein an electronic module for producing voice messages and crowd sounds, in which case there is no need for an outer casing.

I claim:

1. A talking, soft ball for children adapted for playing a game simulating the performance of a professional game, such as football or basketball, said ball comprising:

(a) an outer casing of flexible material having a shape appropriate to the game to be played;

(b) a core of compressible material filling the casing; and (c) an electronic, self-sufficient module nested within the core at a position against an inner surface area of the casing, said module having housed therein an impact sensor generating a command signal upon impact of the ball, a miniature loudspeaker at a position in the module adjacent said inner surface, so that the sounds produced thereby can be heard, a battery power supply, and an integrated circuit chip powered by said supply and activated by said command signal, said chip including a solid-state memory in which is digitally stored different voices messages appropriate to the game, and readout means coupled to the memory which act when the chip is activated to then select at random one of said digitally-stored messages and to decode and amplify the selected message to produce a corresponding audio signal which is applied to said loudspeaker and reproduced thereby.

2. A ball as set forth in claim 1, wherein said memory also has stored therein crowd roar sounds.

3. A ball as set forth in claim 2, wherein said readout means, when it selects a voice message, then also selects said crowd roar sounds, so that when the selected voice message is reproduced, the message is followed by said sounds.

4. A ball as set forth in claim 1, wherein said impact sensor is a piezoelectric element.

5. A ball as set forth in claim 1, wherein said memory is a read-only memory.

6. A ball as set forth in claim 1, wherein said module is provided with a box-like case having a compartment therein to accommodate said battery supply, said compartment having a removable cover at the rear of the case to provide access to the battery.

7. A ball as set forth in claim 6, wherein said loudspeaker is mounted at the front of the case.

8. A ball as set forth in claim 7, wherein the sensor is mounted on the front of the case adjacent the loudspeaker.

9. A ball as set forth in claim 1, wherein said core is formed by cotton batting.

10. A ball as set forth in claim 1, wherein said core is formed by sponge-like, flexible, foam plastic material.

11. A ball as set forth in claim 1, wherein said casing is in the elliptical shape of a football and is formed by contoured sections of synthetic plastic material which are sewed together, the sewing between two adjacent sections having a gap therein to define an elongated slit providing access to the core.

12. A ball as set forth in claim 1, wherein secured to said adjacent sections on opposite sides of the slit are a pair of leather-like patches, each having a row of holes therein through which lacing is threaded.

13. A ball as set forth in claim 12, in which the patches are sewn to the respective sections to create pockets therewith, one of said sections having a tongue extending therefrom which is insertable in the pocket in the adjacent section to overlie said slit.

14. A ball as set forth in claim 13, wherein secured to the underside of the tongue is a fastener component which is engageable with a complementary component secured to the surface of the section in the pocket in which the tongue is insertable.

15. A talking, soft ball for children adapted for playing a game simulating the performance of a professional game, such as football or basketball, said ball comprising:

(a) a body of compressible material having a shape appropriate to the game to be played; and (b) an electronic, self-sufficient module nested within the body at a position adjacent its outer surface, said module having housed therein an impact sensor generating a command signal upon impact of the ball, a miniature loudspeaker at a position in the module adjacent said outer surface, so that the sounds produced thereby can be heard, a battery power supply, and an integrated circuit chip powered by said supply and activated by said command signal, said chip including a solid-state memory in which is digitally stored different messages appropriate to the game, and readout means coupled to the memory which act when the chip is activated to then select at random one of said digitally-stored messages and to decode and amplify the selected message to produce a corresponding audio signal which is applied to said loudspeaker and reproduced thereby.

* * * * *